US012012772B2

(12) United States Patent
Meeks

(10) Patent No.: US 12,012,772 B2
(45) Date of Patent: Jun. 18, 2024

(54) CONCRETE MONUMENT FORMING

(71) Applicants: Robert B. Jordan, IV, Mt. Gilead, NC (US); Eddie Alexander Meeks, Greensboro, NC (US)

(72) Inventor: Eddie Alexander Meeks, Greensboro, NC (US)

(73) Assignees: Robert B. Jordan, IV, Mt. Gilead, NC (US); Eddie Alexander Meeks, Greensboro, NC (US)

( * ) Notice: Subject to any disclaimer, the term of this patent is extended or adjusted under 35 U.S.C. 154(b) by 271 days.

(21) Appl. No.: 17/508,153

(22) Filed: Oct. 22, 2021

(65) Prior Publication Data

US 2022/0127873 A1 Apr. 28, 2022

Related U.S. Application Data

(60) Provisional application No. 63/105,992, filed on Oct. 27, 2020.

(51) Int. Cl.
*E04H 13/00* (2006.01)

(52) U.S. Cl.
CPC ..... *E04H 13/003* (2013.01)

(58) Field of Classification Search
CPC ..... E04H 13/003
USPC ..... 52/103
See application file for complete search history.

(56) References Cited

U.S. PATENT DOCUMENTS 1,373,326 A * 3/1921 Green ..... E04H 13/00 52/139
1,444,179 A * 2/1923 Fiala ..... B28B 7/02 249/158
1,514,053 A 11/1924 Keeter
1,520,849 A * 12/1924 Birnbach ..... B28B 7/0014 249/166
1,531,109 A 3/1925 Lemmon
1,557,946 A * 10/1925 Smith ..... B28B 7/16 249/166
1,563,292 A * 11/1925 Rawls ..... B28B 7/0076 249/103

(Continued)

FOREIGN PATENT DOCUMENTS

DE 3725945 A1 2/1989

OTHER PUBLICATIONS

Concrete Form Liners, Adding Designs to Architectural Formed Vertical Concrete Surfaces, The Concrete Network (file://sql1/ProLawFiles/PLDocs/10278-022P/HAM/299385.htm).

(Continued)

*Primary Examiner* — James J Buckle, Jr.
(74) *Attorney, Agent, or Firm* — MacCord Mason PLLC

(57) ABSTRACT

A kit for forming a monument includes a backplate having a top surface, a plurality of tiles that each have a face with a raised symbol on the face configured to be positioned selectively on the top surface of the backplate, and a perimeter frame sized to mate with the backplate to form a cavity. The tiles can be located in positions on the top surface of the backplate, the perimeter frame can be affixed to the backplate, and a moldable material can be flowed into the cavity where the moldable material can harden. The perimeter frame, backplate and tiles can then be removed from the hardened moldable material, leaving a hardened material with a surface having a recess formed by the raised symbol.

10 Claims, 5 Drawing Sheets

(56) References Cited

U.S. PATENT DOCUMENTS

| | | | | |
|---|---|---|---|---|
| 1,586,352 | A | 5/1926 | Cochran | |
| 1,871,413 | A * | 8/1932 | Koch | B28B 7/36<br>425/182 |
| 1,931,358 | A | 10/1933 | Richards et al. | |
| 1,951,132 | A | 3/1934 | Cox | |
| 2,274,192 | A | 2/1942 | Deaton | |
| 5,595,029 | A | 1/1997 | Revoir et al. | |
| 5,730,797 | A | 3/1998 | Parrish et al. | |
| 8,312,679 | B1 * | 11/2012 | Rosckes | A01G 9/28<br>47/33 |
| 10,997,878 | B2 * | 5/2021 | Culhane | G09F 23/00 |
| 2002/0178672 | A1 | 12/2002 | Robinson et al. | |
| 2007/0107276 | A1 | 5/2007 | Peterson | |
| 2013/0061540 | A1 | 3/2013 | Denney | |

OTHER PUBLICATIONS

Creating Unique Concrete Form Liners, Concrete Decor (file://sql1/ProLawFiles/PLDocs/10278-022P/HAM/299384.htm).
Photo of post of cast concrete.
European Search Report dated Mar. 24, 2022 for European Application No. 21204655.1.

* cited by examiner

CONCRETE MONUMENT FORMING

BACKGROUND OF THE INVENTION

Pet owners often become very attached to their pets and grieve at the death of the pet. When such a loss occurs, the pet owner often wants to inter the pet and mark the memory of the pet with a memorial, or otherwise to create a memorial monument for a pet. Other occasions of creating a monument can also arise.

Monuments of this sort are usually placed outside, so they must withstand weather in order to provide a durable monument and memorial. However, traditional grave headstones are expensive, requiring quarrying and carving by a craftsman, measures that may seem too extreme in the circumstances.

Accordingly, there is a need in the art for a relatively low-cost way to make a durable, customizable monument, typically resembling a headstone.

SUMMARY OF THE INVENTION

The present invention fulfills one or more of these needs in the art by providing a kit for forming a monument. The kit includes a backplate having a top surface, a plurality of tiles that each have a face with a raised symbol on the face configured to be positioned selectively on the top surface of the backplate, and a perimeter frame sized to mate with the backplate to form a cavity. The tiles can be located in positions on the top surface of the backplate, the perimeter frame can be affixed to the backplate, and a moldable material can flow into the cavity where the moldable material can harden. This is followed by removal of the perimeter frame, backplate and tiles from the hardened moldable material, leaving a hardened material with a surface having one or more recesses formed by the raised symbol(s).

The top surface of the backplate may have spaced-apart T-bars that have crosspieces forming slots between the crosspieces of the T-bars and the top surface of the backplate, and the tiles have edges sized to fit into the slots. Preferably, the tiles have edges of differing thicknesses so that a tile slid between two T-bars only fits one way. Various ones of the tiles may be wider than other ones of the tiles.

The backplate and perimeter frame may have cooperating snaps to releasably hold the backplate and perimeter frame together as moldable material flows into the cavity and hardens. The perimeter frame may have one or more slots on a rear face, so that a flat head screwdriver can be inserted in the slot to pry the backplate and perimeter frame apart once the moldable material has hardened. The perimeter frame may have reinforcing rings.

The faces of the tiles preferably have profiles such that the tiles are coplanar with tops of the T-bars when installed in the T-bars, except for the raised symbol on the face. Additional tiles may each have a face with a profile such that the tiles are coplanar with tops of the T-bars when installed in the T-bars and have no raised symbol on the face to form blank spaces.

The perimeter frame may have an inner lip of a thickness the same as a bottom-most T-bar to give finished molded article a plane that is flat and uniform, except for the recesses.

The invention can also be considered as a monument made of a molded material having a predominantly right parallelepiped shape with a curved top. One face of the molded material has visible recesses. The material obtained its shape by having been poured in a flowable form into a mold defining a bottom, sides and a top of the right parallelepiped shape so that tiles on the bottom of the mold prevent flowing of the flowable material into raised symbols on the tiles, forming the visible recesses in the face. The material is allowed to set, followed by disassembling a perimeter frame of the mold from a backplate of the mold to release the molded material from the mold.

BRIEF DESCRIPTION OF THE DRAWINGS

The invention will be better understood by a reading of the Detailed Description of the Examples of the Invention along with a review of the drawings, in which.

DETAILED DESCRIPTION

The kit is useful for forming a monument such as a headstone and includes a backplate 40, tiles 20, and a perimeter frame 60. The kit enables easy use by a consumer to provide an attractive memorial for a pet. The kit can be used to make monuments or other molded articles for other purposes.

Figure 1:
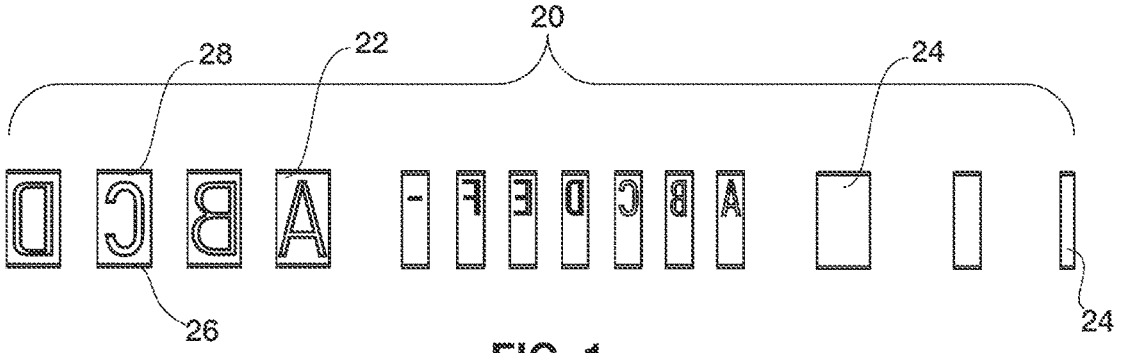
FIG. 1 is a schematic view of several tiles useful as parts of the kit.
Figure 2:
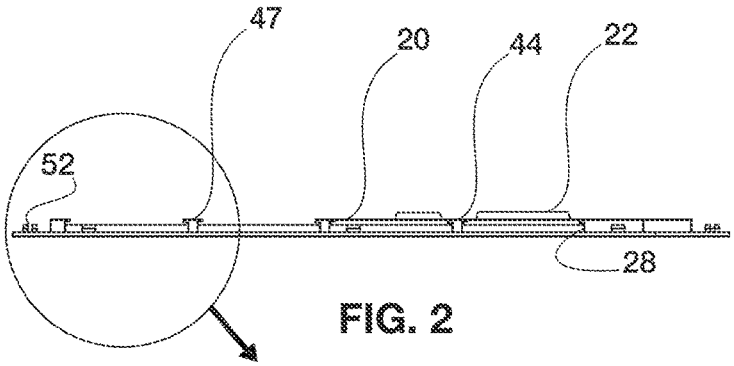
FIG. 2 is a side view of a backplate with tiles in place.
Figure 3:
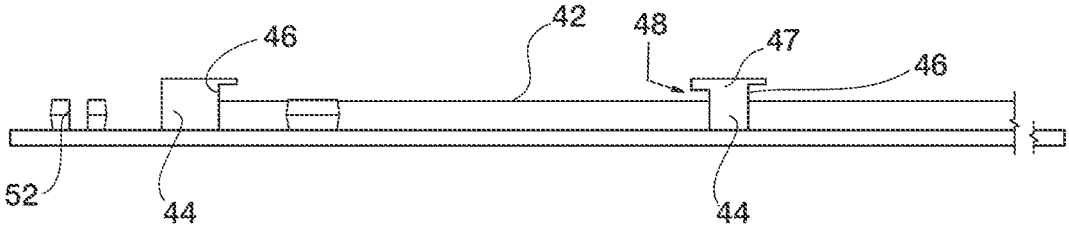
FIG. 3 is an enlarged portion of the view of FIG. 2.

The tiles 20 are seen in FIG. 1, the backplate 40 is seen in FIGS. 2-5 and 8, and the perimeter frame 60 is seen in FIGS. 6-9. The backplate 40 has a top surface 42 that has spaced-apart T-bars 44 that extend across most of the backplate. Crosspieces 47 of the T-bars form wider slots 46 and narrower slots 48 with the top surface 42 of the backplate 40.

Slots 46 and 48 are formed as the spaces between the crosspieces 47 of T-bars and the top surface 42 of the backplate. Slot 48 has a shorter depth than the lower slot 46. Complementarily, the tiles 20 have faces with raised symbols 22 (or blanks 24) on their faces and edges 26, 28 sized differently from each other, so they snugly fit into the slots. As a result, the tiles with their letters or blank spacers can only slide into the rows one way, so the person preparing the mold doesn't accidentally install a letter backwards or upside down.

Typically, the raised symbols 22 are letters so they can be arranged in a pattern to spell a pet's name (or other word). Other symbols such as numbers and graphics can be used. The perimeter frame 60 is sized to mate with the backplate to form a cavity 80.

The tiles can be positioned on the backplate by sliding between two of the T-bars 44. Then, the perimeter frame 60 can be affixed to the backplate 40, and a moldable material 90 can be flowed into the cavity 80. After the moldable material 90 hardens, the perimeter frame 60 and backplate 40 are removed, leaving a hardened material with a surface having a recess 94 formed by the raised symbols.

Figure 4:
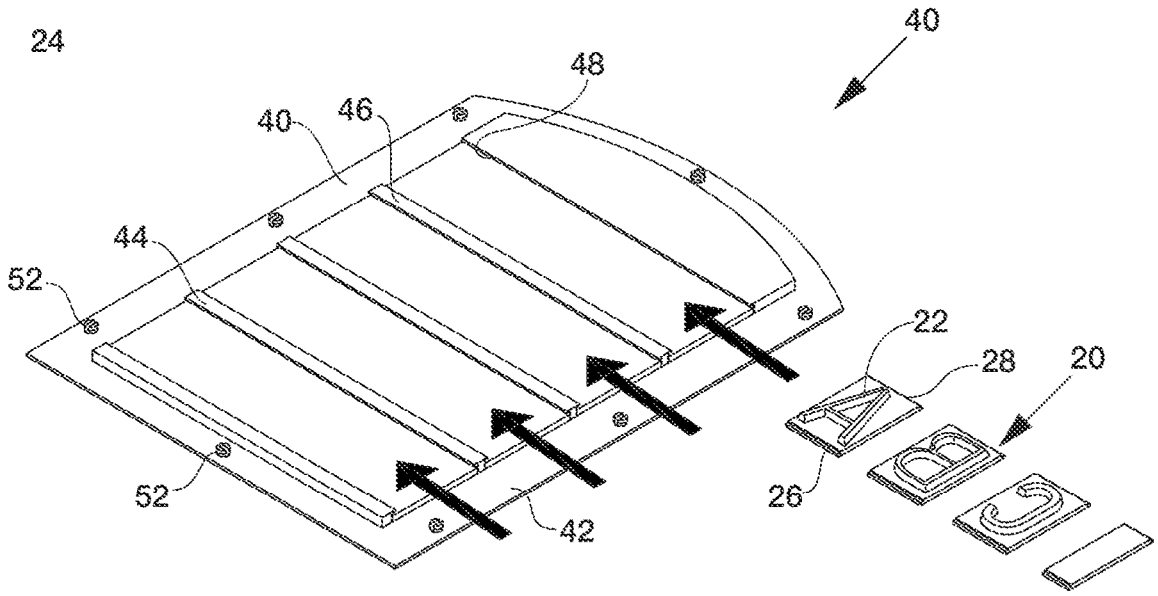
FIG. 4 is a perspective view showing how the tiles are located in slots on the top surface of the backplate.
Figure 5:
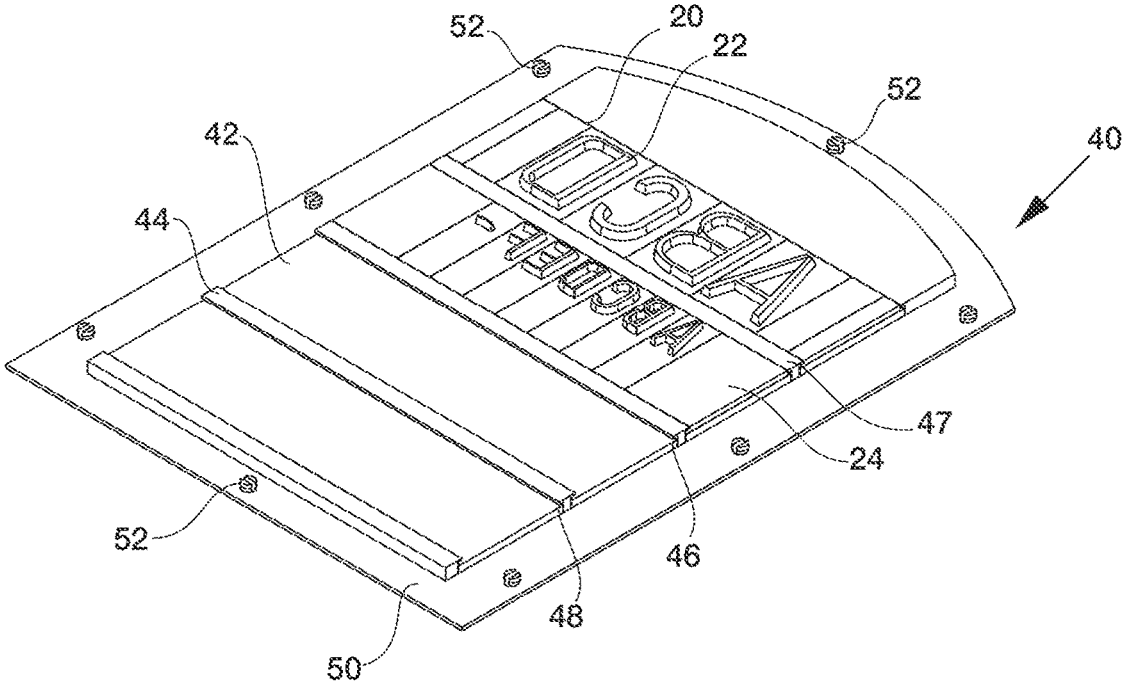
FIG. 5 is a perspective view of a backplate with tiles in place.
Figure 6:
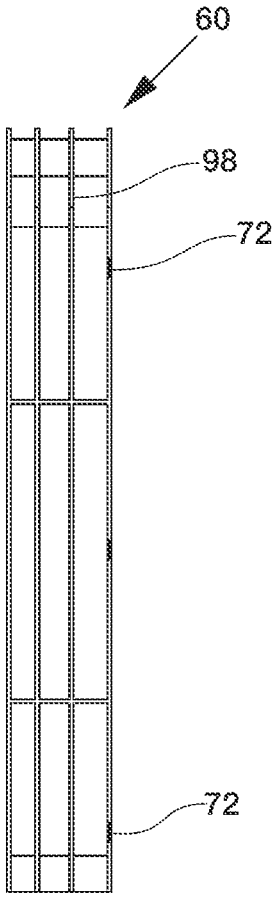
FIG. 6 is a side view of the perimeter frame.

FIG. 5 shows the backplate 40 with letter rows loaded with tiles 20 and FIG. 4 illustrates the process of loading the tiles along the slots 46, 48. Letters and blank spacers may be provided in different widths, as seen in FIGS. 1 and 5. For example, tiles 22 with letters may be provided as two inch wide and one inch wide variations. Blank spacers may also come in various widths, such as two inch, one inch and one-half inch.

Seen in FIG. 4 is a side view of a sample letter "A" where edges 26 and 28 of differing thickness mate into slots 46 and 48 seen just prior to sliding in place, and in place in FIG. 5. A one-half inch blank spacer, a one inch blank spacer, and a sample letter set along with a two inch blank spacer and a sample one inch are seen installed in the rows in FIG. 5.

Figure 7:
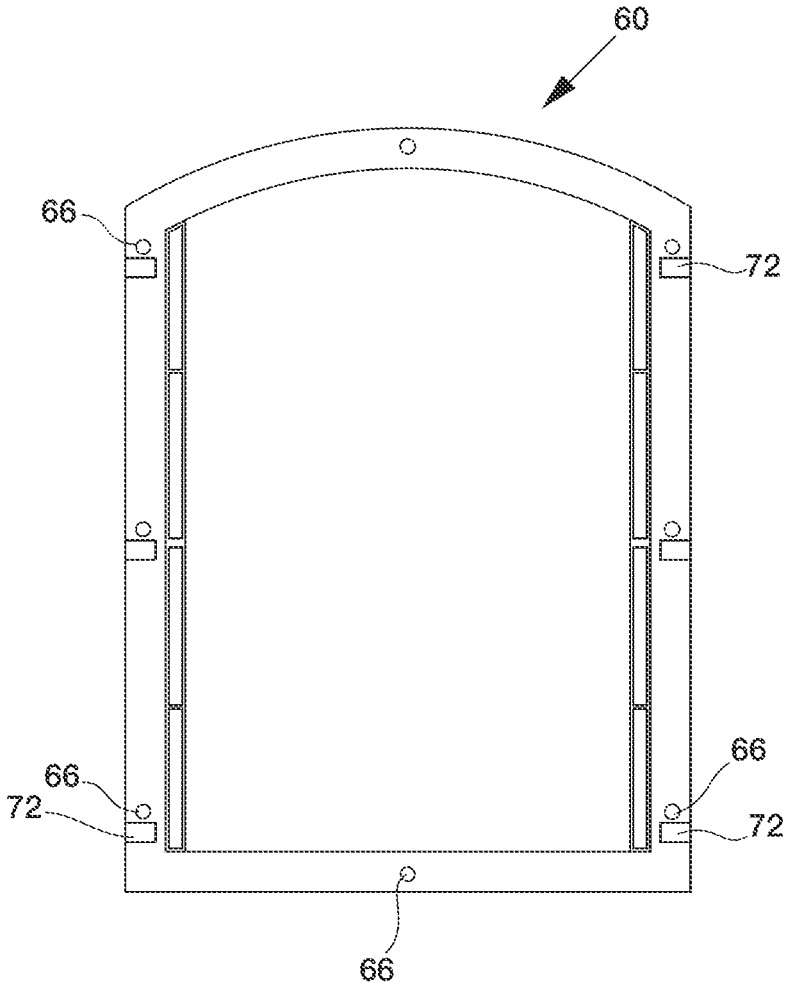
FIG. 7 is a bottom view of the perimeter frame.
Figure 8:
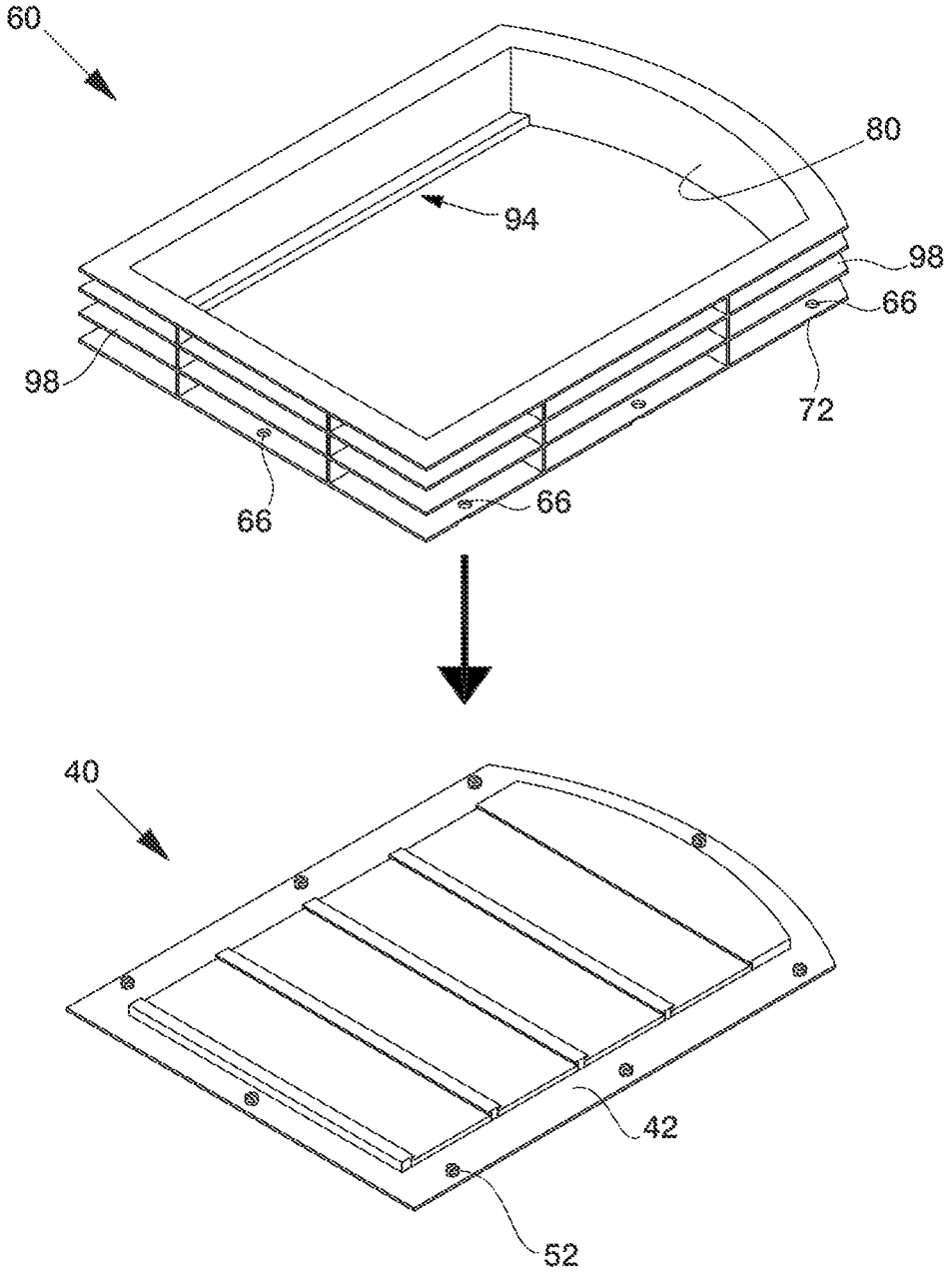
FIG. 8 is a schematic, exploded view showing engagement of the perimeter frame with the back plate.

Backplate 40 may include a flat perimeter 50 that has male parts 52 of a snap that assembles to the female counterpart 66 located on perimeter frame 60, seen in FIGS. 7 and 8. Once the backplate 40 has been loaded with the lettering and spacers as one wishes, the perimeter frame 60 is placed over the backplate 40 (FIG. 8) and snapped together by pressing the male parts 52 into the female counterparts 66. The relative positions of the male and female snap elements can be reversed and other means of holding the backplate and perimeter frame together may be used.

Any areas of rows that do not call for any lettering may be filled with blank spacer tiles so if the letters for a particular usage only takes up less than all of the available rows, then the other rows may be filled with blank spacers to bring the unused rows up to the level of the tops of T-bars 47. An inner lip 94 of the perimeter frame 60 is the same width as and coincides with the T-bars 47 so to give an equal border (perimeter) around the finished piece, contributing the flatness of the finished face.

The perimeter frame 60 has strengthening ribs 98. Also, the bottom of the perimeter frame has slots 72 near the female snaps 16. A user may insert a flat head screwdriver into the slots 72 to pry the backplate and perimeter frame apart to un-snap the snaps for the removal of the perimeter frame once the concrete or other moldable material has dried and set so the finished piece is ready for removal.

The elements of the kit can advantageously be molded of plastic; many plastics will readily release the molded concrete, so release agents may not be needed.

Figure 9:
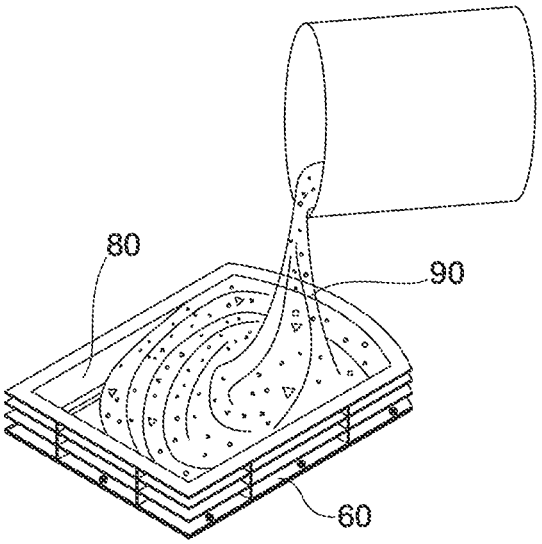
FIG. 9 shows the pouring of a moldable material into the assembled mold.

FIG. 9 shows the pouring of the flowable material 90, for example concrete, into the cavity 80 of the assembled backplate 40 and perimeter frame 60.

Figure 10:
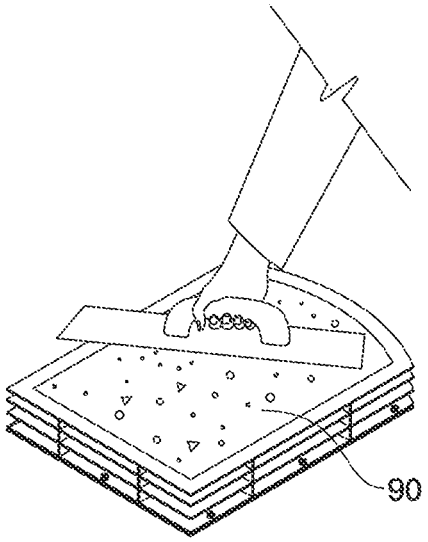
FIG. 10 shows the process of troweling the back face of the moldable material to provide a smooth back for the monument.
Figure 11:
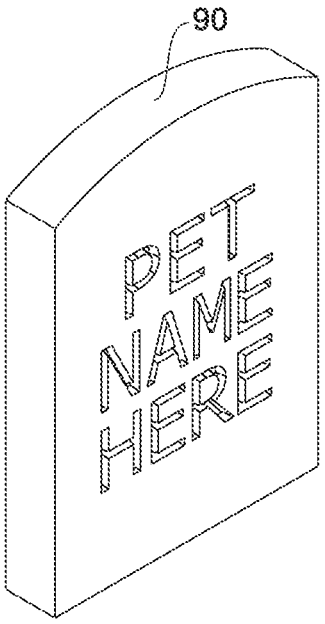
FIG. 11 shows a completed monument after removal of the mold from the set moldable material.

FIG. 10 shows a person with a trowel smoothing the topmost face of the poured flowable material to make a flat, smooth surface, typically forming the back face of the monument. The finished monument with mold removed is shown in FIG. 11.

While in most cases, the flowable material that is used to make the monument will be concrete, other moldable materials can be used, as long as they are compatible with and releasable from the mold. Examples may include various plasters, silicones, and moldable clays. U.S. Pat. No. 5,730,797 to Parrish et al. discloses a mortar composition that is said to be well-adapted for molding.

Certain modifications and improvements will occur to those skilled in the art upon reading the foregoing description. It should be understood that all such modifications and improvements have been omitted for the sake of conciseness and readability but are properly within the scope of the following claims.

What is claimed is:

1. A kit for forming a monument comprising a backplate having a top surface, and wherein the top surface having spaced-apart T-bars that have crosspieces forming slots between the crosspieces of the T-bars and the top surface of the backplate, a plurality of tiles that each have a face with a raised symbol on the face configured to be positioned selectively on the top surface of the backplate and wherein the tiles have edges sized to fit into the slots, and a perimeter frame sized to mate with the backplate to form a cavity, so the tiles can be located in positions on the top surface of the backplate, the perimeter frame can be affixed to the backplate, and a moldable material can flow into the cavity where the moldable material can harden, followed by removal of the perimeter frame, backplate and tiles from the hardened moldable material, leaving a hardened material with a surface having a recess formed by the raised symbol.

2. A kit as claimed in claim 1 wherein the crosspieces of the T-bars form slots of differing thickness on either side of the T-bars, and the tiles have edges of differing thicknesses so that a tile slid between two T-bars only fits one way.

3. A kit as claimed in claim 1 wherein the backplate and perimeter frame have cooperating snaps to releasably hold the backplate and perimeter frame together as moldable material is flowed into the cavity and hardened.

4. A kit as claimed in claim 1 wherein the perimeter frame has a slot on a rear face, so that a flat head screwdriver can be inserted in the slot to pry the backplate and perimeter frame apart once the moldable material has hardened.

5. A kit as claimed in claim 1 wherein the perimeter frame has reinforcing rings.

6. A kit as claimed in claim 1 wherein the faces of the tiles have profiles such that the tiles are coplanar with tops of the T-bars when installed in the T-bars, except for the raised symbol on the face.

7. A kit as claimed in claim 1 including tiles that each have a face with a profile such that the tiles are coplanar with tops of the T-bars when installed in the T-bars and have no raised symbol on the face.

8. A kit as claimed in claim 1 wherein the perimeter frame has an inner lip of a thickness the same as a bottom-most T-bar to give an equal border around the finished piece.

9. A kit as claimed in claim 1 wherein the various ones of the tiles are wider than other ones of the tiles.

10. A kit for forming a monument comprising a backplate having a top surface, the top surface having spaced-apart T-bars that have crosspieces forming slots between the crosspieces of the T-bars and the top surface of the backplate, first tiles configured to be positioned selectively on the top surface of the backplate and having edges sized to fit into the slots, the tiles each having a face with a profile such that the tiles are generally coplanar with tops of the T-bars when installed in the T-bars but with a raised symbol on the face, second tiles that each have a face with a profile such that the tiles are coplanar with tops of the T-bars when installed in the T-bars and have no raised symbol on the face, and a perimeter frame sized to mate with the backplate to form a cavity, the backplate and perimeter frame having cooperating snaps to releasably hold the backplate and perimeter frame together, the perimeter frame having a slot on a rear face, so that a flat head screwdriver can be inserted in the slot to pry the backplate and perimeter frame apart, so the tiles can be located in positions on the top surface of the backplate, the perimeter frame can be affixed to the backplate, and a moldable material can flow into the cavity where the moldable material can harden, followed by removal of the perimeter frame, backplate and tiles from the hardened moldable material, leaving a hardened material with a surface having a recess formed by the raised symbol.

* * * * *